US005119608A

United States Patent [19]

Glover et al.

[11] Patent Number: 5,119,608

[45] Date of Patent: Jun. 9, 1992

[54] CONVECTION GAS FLOW INHIBITOR

[75] Inventors: Michael Glover, Ottawa; John Wright, Heidelberg; Gerhard Reichart, Ottawa, all of Canada

[73] Assignee: Lauren Manufacturing Company, New Philadelphia, Ohio

[21] Appl. No.: 515,080

[22] Filed: Apr. 26, 1990

[51] Int. Cl.[5] ..... F04C 2/54; F06B 7/12

[52] U.S. Cl. ..... 52/171; 52/399; 52/790

[58] Field of Search ..... 52/171, 172, 788, 789, 52/790, 399

[56] References Cited

U.S. PATENT DOCUMENTS

| | | | |
|---|---|---|---|
| 49,167 | 8/1865 | Stetson . | |
| 2,132,217 | 10/1938 | Neuendorf . | |
| 2,915,793 | 12/1959 | Berg . | |
| 3,996,710 | 12/1976 | Nuss | 52/788 |
| 4,091,592 | 5/1978 | Berlad | 52/788 |
| 4,155,205 | 5/1979 | Polman | 52/171 |
| 4,207,869 | 6/1980 | Hart . | |
| 4,536,424 | 8/1985 | Laurent | 52/171 |
| 4,563,843 | 1/1986 | Grether | 52/790 |
| 4,791,762 | 12/1988 | Hwang | 52/171 |
| 4,831,799 | 5/1989 | Glover | 52/789 |

FOREIGN PATENT DOCUMENTS

| | | | |
|---|---|---|---|
| 2647337 | 4/1978 | Fed. Rep. of Germany | 52/171 |
| 2808432 | 9/1979 | Fed. Rep. of Germany | 52/171 |
| 595472 | 2/1978 | U.S.S.R. | 52/788 |
| 817526 | 7/1959 | United Kingdom | 52/788 |

*Primary Examiner*—John E. Murtagh

*Attorney, Agent, or Firm*—Wenderoth, Lind & Ponack

[57] ABSTRACT

There is described a multi-pane glazing unit, having top and bottom edges and two side edges. The glazing unit includes two parallel glazing sheets enclosing a vertical cavity. A convective-flow barrier is position adjacent to and extending substantially along the bottom edge of the glazing unit within the cavity. In operation, cold-side convective flow is prevented by the barrier from directly reaching a bottom region of the warm-side glazing sheet.

20 Claims, 3 Drawing Sheets

CONVECTION GAS FLOW INHIBITOR

BACKGROUND OF THE INVENTION

1. Field of the Invention

This invention relates to a multiple-pane glazing unit and in particular to a glazing unit incorporating a peripheral insulating spacing-and-sealing assembly.

2. Description of the Prior Art

Conventional multiple-pane glazing units consist of two or more parallel sheets of glass which are typically spaced apart from each other using a peripheral spacing-and-sealing assembly which conventionally consists of a inner hollow metal spacer filled with desiccant-bead material and an outer hermetic-seal made from sealant material which adheres to the glazing sheets and the back face of the metal spacer. To reduce radiation heat loss, the glazing units can incorporate a low-emissivity coating which is applied to one of the glazing sheets and to further reduce conductive heat loss from the glazing, the cavity between the glazing sheets can also be filled with a low-conductive gas such as argon. Conductive heat loss through the spacing-and-sealing assembly can also be reduced by replacing the conductive metal spacer with an insulating spacer.

As disclosed in U.S. Pat. No. 4,831,799 issued to Glover et al., one advantage of substituting an insulating spacer is that the cold-weather problem of edge-of-glass condensation is diminished. However, experience has shown that although the substitution of an insulating spacer substantially reduces conductive heat loss through the perimeter edge seal, condensation at the bottom edge-of-glass area can still occur particularly if there is extreme cold weather and high interior humidity levels. These cold bottom-edge temperatures are primarily caused by surface convective flow of the air or gas fill within the high thermal-performance, double-glazed units.

In the past, various assemblies have been incorporated within the double-glazed unit and although typically these assemblies were added for mainly aesthetic reasons, these assemblies will also tend to interfere with surface convective flow within the unit. Listed below are examples from the prior art.

U.S. Pat. No. 49,167 issued to Stetson, describes the use of wood studs which are incorporated in the sealed unit to prevent the center parts of the glazing sheets from coming in contact with each other.

U.S. Pat. No. 2,132,217 issued to Neuendorf, describes a muntin-bar grid incorporated in a sealed unit in order to give the appearance of divided lights and this muntin-bar grid creates a series of small dead-air spaces and as a result, convective flow within the sealed unit is reduced to some degree.

U.S. Pat. No. 2,915,793 issued to Berg, describes a sealed glazing unit incorporating a venetian window-blind assembly suspended between the glazing sheets and this blind assembly provides privacy and also helps control light transmission. The venetian-blind assembly consists of moveable, closely-spaced, horizontal slats which create a series of small dead air spaces and as a result, convective flow within the sealed unit is reduced to some degree.

U.S. Pat. No. 4,207,507 issued to Hart, describes a solar-collector panel with a series of horizontal strips of transparent-film material suspended between the glazing sheets. These flat parallel strips which are spaced closely together, are specifically designed to reduce convective heat loss between the solar collector absorber and the exterior glazing. Compared to vertically-installed windows, convective heat loss for solar collectors is a more significant problem because these collectors are operated at higher temperatures and are typically installed at an inclined slope or angle. Hart also describes a window assembly of similar construction to the solar-collector panel except that the solar absorber and collector housing are replaced by a second transparent glazing panel. Because the inner and outer glazing layers are spaced widely apart, a series of circular convective-flow cells are set up between the two glazing sheets and the horizontal strips are designed to reduce this air or gas circulation between the glazing sheets. However for a conventional sealed unit, the glazing sheets are spaced closer together and as a result of the reduced cavity width, convective circulation between the glazing layers is substantially reduced. Further it should be noted that as with the other previously-described additions to the air-space, the horizontal strips do not specifically address the problem of convective flow at the bottom edge of the cavity.

SUMMARY OF THE INVENTION

The present invention provides a multiple-pane glazing unit having top and bottom edges and two side edges, and compromising at least two parallel glazing sheets enclosing at least one vertical cavity, the improvement comprising a convective-flow barrier positioned adjacent to the bottom edge and extending substantially along the bottom edge the cavity, whereby in operation, the cold-side convective flow is prevented by the barrier from directly reaching the bottom edge-of-glass region of the warm-side glazing sheet.

The glazing unit can also incorporate a second barrier positioned adjacent to the top edge and extending substantially along the top edge of the cavity, whereby in operation, the warm-side convective flow is prevented by the barrier from directly reaching the top edge-of-glass region of the cold-side glazing sheet.

One preferred embodiment for the convective-flow barrier is a vertical fence which is located between and parallel to the glazing sheets. The optimum height of the barrier varies depending on the height and width of the cavity but except for very small glazing units, the minimum height of the vertical fence is about two inches. For ease of assembly of the glazing unit, the convective-flow barrier can be fabricated from an inverted T-shaped or I-shaped, extruded plastic profile. The convective-flow barrier can also be made from a transparent sheet material such as glass or plastic and an anti-reflective coating can be applied to ensure that the barrier is visually unobtrusive.

A second preferred embodiment is to provide the convective-flow barrier as a horizontal flat strip which is located about two inches above the bottom edge of the unit.

A third preferred embodiment is to provide the convective-flow barrier as a vertical fin which is fabricated as an integral part of a special spacer profile incorporated at the bottom and possibly also at the top of the spacer-frame subassembly of a sealed unit.

A fourth preferred embodiment is to fabricate the convective-flow barrier from a strip of transparent, translucent or opaque insulating sheet material. Appropriate material options include: silicone foam, acrylic hollow-fibre sheet, rock wool, aerogel, honeycomb sheet, and fiberglass material. The insulating strip is located directly adjacent to the interior glazing at the bottom edge and may substantially fill the bottom region of the cavity between the glazing sheets. Alternatively, the strip can be located directly adjacent to the warm-side glazing and extend about the half cavity width of the glazing unit. To help dampen convective-flow circulation, one preferred material for the insulating strip material is fiberglass insulation.

BRIEF DESCRIPTION OF DRAWINGS

The following is a description by way of example of certain embodiments of the present invention, reference being made to the accompanying drawings, in which.

DETAILED DESCRIPTION

Figure 1:
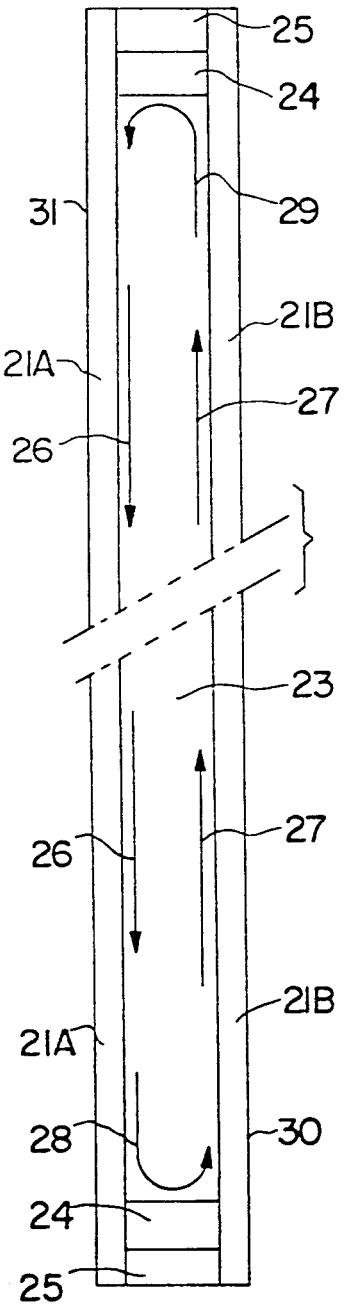
FIG. 1 is a vertical cross-section of a conventional double-glazed unit.

Referring to the drawings, FIG. 1 shows a vertical cross section of a conventional double-glazed unit. The unit consists of two parallel glazing sheets 21A and 21B separated by a peripheral spacing-and-sealing assembly. A low-e coating may be typically applied to one of the glazing sheets and the vertical cavity 23 between the glazing layers can contain air or be filled with a low-conductive gas such as argon. Although various peripheral spacing-and-sealing assembly can be used, the specific insulating edge-seal design illustrated in FIG. 1 consists of an inner desiccant-filled foam spacer 24 backed up by an outer sealant 25 and this particular spacer-and-sealing assembly is described in U.S. Pat. No. 4,831,799 issued to Glover et al. The double-glazed unit is typically incorporated within a window or door frame and in operation, the glazing unit is typically installed vertically so that under "cold-weather" conditions, the glazing sheet 21A is on the cold side and the glazing sheet 21B is on the warm side of the window or door assembly.

It should be noted that while the glazing units are typically incorporated in the exterior envelope of a building, the units may also be incorporated in other types of envelope assemblies where there is a temperature differential across the glazing unit and these other envelope assemblies, include: display doors for freezers and windows for transportation vehicles.

As shown in FIG. 1, under "cold-weather" conditions, the air or gas fill in the double-glazed unit flows downwards near the cold exterior glazing sheet 21A, as shown by arrow 26, and upwards near the warm interior glazing sheet 21B, as shown by arrow 27. As the gas adjacent to cold exterior glazing descends, it becomes progressively colder and at the bottom of the sealed-unit cavity, this cold fill gas turns, as shown by arrow 28, and comes in direct contact with the bottom region 30 of the interior glazing sheet 21B. Consequently, the glass near the bottom edge of the interior glazing sheet is cooled by the coldest fill gas within the sealed unit and this cooling effect contributes significantly to the potential condensation problem on the bottom edge-of-glass region 30. A similar situation occurs at the top of the cavity where the ascending warm fill gas adjacent to the interior glazing turns, as shown by arrow 29, and comes in direct contact with the top edge-of-glass region 31 of the cold exterior glazing 21B. As a result, there is accentuated heat loss through the top edge-of-glass region 31. Further, it will of course be understood that under "warm-weather" conditions the roles of the cold side and warm side of the unit will be reversed.

Figure 2:
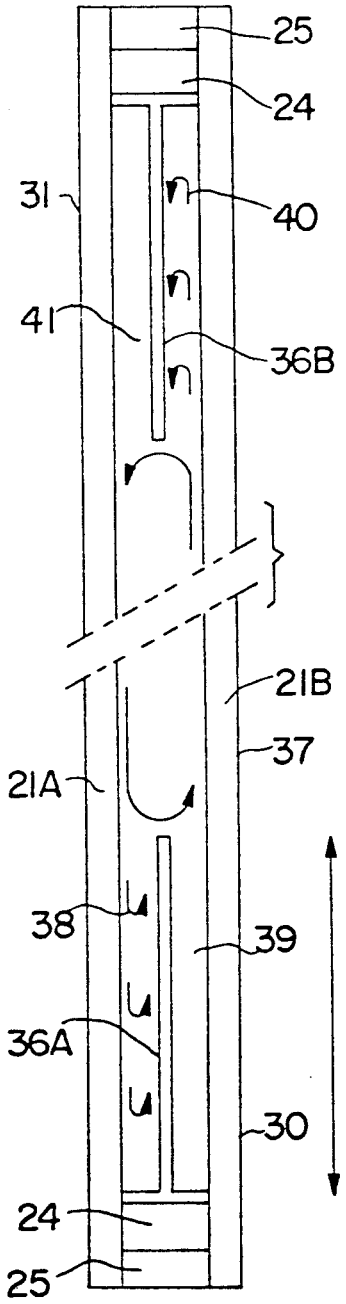
FIG. 2 is a vertical cross-section of a double-glazed unit incorporating a vertical-fence, convective-flow barrier at the bottom and top edges.

FIG. 2 shows a vertical cross-section of a double-glazed unit of similar construction to the unit described in FIG. 1 but incorporating an embodiment of the present invention. To prevent the descending cold air or gas from reaching the bottom region 30 of the interior glazing sheet 21B, a convective-flow barrier 36A is positioned along the bottom edge of the double-glazed unit. The specific type of convective-flow barrier shown in FIG. 2 is a vertical-fence barrier 36A which is positioned adjacent to and extending substantially along the bottom edge of the unit. The vertical-fence barrier 36A is located approximately at the center of the air or gas-fill space between the glazing sheets 21A and 21B which are typically spaced about a ½ inch apart. By using the vertical-fence barrier to block the flow path of the cold gas, the coldest area on the interior glazing is moved from the bottom edge of the double-glazed unit to a location 37 just above the top edge of the vertical-fence 36A. As illustrated in FIG. 2, the vertical-fence barrier 36A (bottom edge) is an inverted T-section profile extrusion made from transparent, ultraviolet-resistant plastic. Because of its high light transmission properties, transparent acrylic plastic is the preferred material.

As described in the experiments outlined below, for a glazing unit with a ½ inch airspace and 20 inches in height, the introduction of the convective-flow barrier can increase the bottom minimum edge-of-glass temperature of the interior glazing sheet from 8° C. to at least 11° C. under "cold-weather" conditions (−17° C. outside temperature). This temperature increase is significant as it means that at −17° C., the allowable interior relative humidity levels can be increased from about 45 to 60 per cent without causing edge-of-glass condensation.

The experiments also showed that for the particular unit size evaluated (½ inch airspace and 20 inches in height), the optimum height h is about two inches. However for other unit sizes, the optimum height may vary, although except for very small units, the minimum height h should be about two inches. Further, the experiments showed that the introduction of the convective-flow barrier can also increase the average glass temperature indicating that overall heat loss from the glazing units is also reduced.

By modifying the downward convective flow, the vertical-fence barrier is effective for the following three reasons. First, the vertical-fence barrier 36A helps to separate the cold-edge effects due to conductive heat flow through the edge seal from the cold-edge effects due to cold convective-flow across the bottom edge of the sealed-glazing cavity. Second, the vertical-fence barrier 36A helps set up convective-flow cells in the narrow cavity between the exterior glazing sheet 21A and the vertical fence 36A and as a result of transferring this turbulent mixing, illustrated by arrows 38, away from the bottom region 30 of the interior glazing 21B, heat loss from the interior glazing is reduced. Third, the vertical-fence barrier helps to create a stagnant air or gas-fill pocket 39 between the vertical fence 36A and the interior glazing sheet 21B and because of the low-conductivity of the air or gas-fill, conductive heat loss is reduced across this bottom edge-of-glass region.

As well as being located at the bottom edge of the glazing unit, the convective-flow barrier 36B can also be located at the top edge of the unit. Under "cold-weather" operation, the top-edge, convective-flow barrier 36B prevents the upward flow of warm gas-fill adjacent to the interior glazing sheet from directly reaching the top edge-of-glass region 31 of the cold exterior glazing 21A.

By modifying the upward warm convective flow, the barrier is effective for the following three reasons. First, the temperature of the top-of-glass region of the interior glazing 21B is reduced and so the temperature differential between the top edges of the exterior and interior glazing sheets is also reduced resulting in lower conductive heat loss. Second, the vertical-fence barrier 36B helps set up convective-flow cells in the narrow cavity between the interior glazing sheet 21B and the vertical fence 36B and as a result of transferring this turbulent mixing, as illustrated by arrows 40, away from the top region 31 of the exterior glazing 21A, heat loss from the exterior glazing is reduced. Third, the barrier 36B helps create a stagnant gas-fill pocket 41 between the vertical-fence barrier 36B and the exterior glazing 21A and because of the low conductivity of the air or gas fill, this stagnant pocket helps reduce conductive heat flow through the top edge-of-glass area. In contrast to the bottom-edge barrier, there appears to be no optimum height for the top-edge barrier but a minimum height of about two inches is required to significantly reduce heat loss through the top edge-of-glass area.

Figure 3:
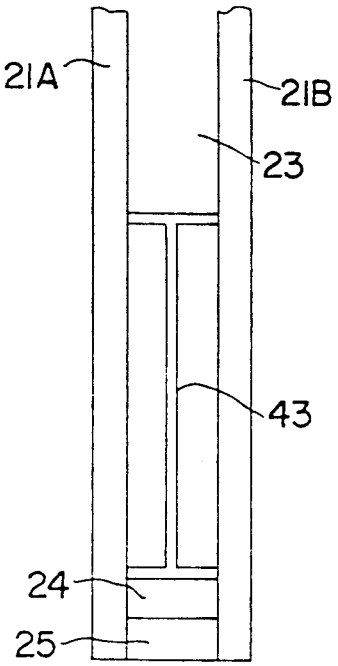
FIG. 3 is a vertical cross-section of the bottom edge of a double-glazed unit incorporating a convective-flow barrier made from an I-shaped, extruded-plastic profile.
Figure 4:
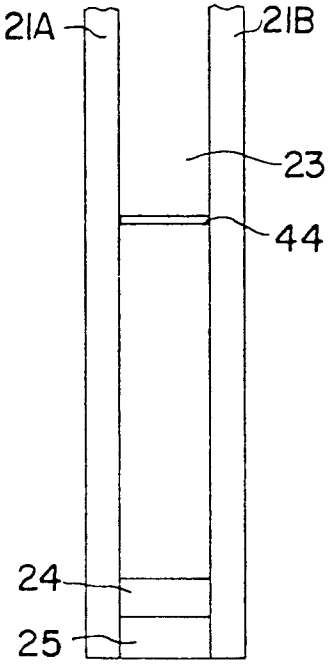
FIG. 4 is a vertical cross-section of the bottom edge of a double-glazed unit incorporating a horizontal convective-flow barrier.

As illustrated in FIG. 3, the convective-flow barrier can also be fabricated from an I-shaped section 43. Other profile shapes which can be used for the convective-flow barrier, include: V, A, O, X, T, N and S-shaped profiles. The convective-flow barrier can also be designed as a sloped-fence barrier at an inclined angle to the vertical. As illustrated in FIG. 4, the convective-flow barrier can be a horizontal strip or barrier 44 which is located parallel to and extending along the full width of the sealed unit. For effective performance, the strip should be located about two inches above the bottom edge of the sealed unit.

Figure 5:
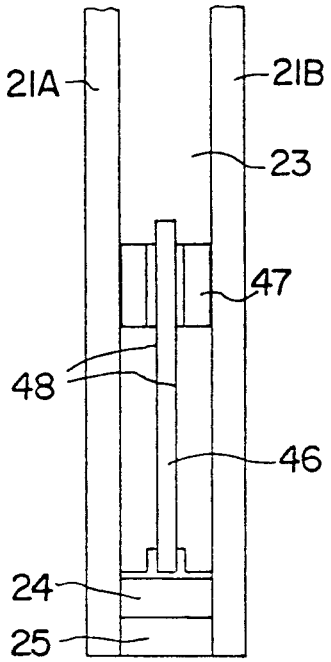
FIG. 5 is a vertical cross-section of the bottom-edge of a double-glazed unit incorporating a vertical-fence, convective-flow barrier made from glass-sheet material.

As well as fabricating the convective-flow barrier as an extruded profile, the barrier can be made from transparent plastic or glass sheet material and also from plastic film material. As shown in FIG. 5, the vertical fence can be made from a glass sheet 46 which is held in position by slotted-support brackets or clips 47 located on the bottom edge and on the sides. The strip can also be held in position by other means, including: inserting the sheet material in a slot-profile spacer; bonding the sheet material to the spacer with adhesive, and mechanically fixing the sheet material to the spacer. To ensure that the convective-flow barrier 46 is not visually obtrusive, various measures can be taken such as coating the transparent material with an anti-reflective coating 48.

Figure 6:
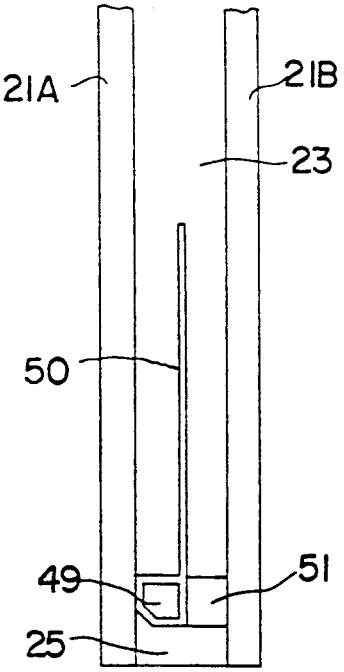
FIG. 6 is a vertical cross-section of the bottom edge of a double-glazed unit where the vertical-fence, convective-flow barrier is an integral part of a thermally-broken metal spacer assembly.
Figure 7:
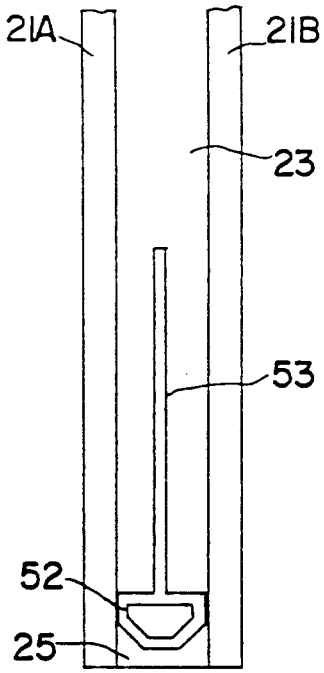
FIG. 7 is a vertical cross-section of the bottom edge of a double-glazed unit where the vertical-fence, convective-flow barrier is an integral part of a pultruded plastic spacer assembly.

Alternatively, rather than trying to make the convective-flow barrier invisible to the human eye, the barrier can be made from an opaque strip of material 50. As shown in FIGS. 6 and 7, the vertical fence can be made as an integral part of the spacer assembly. In FIG. 6, the spacer assembly is a hollow-profile metal spacer 49 incorporating a metal vertical fin 50 which serves as the convective-flow barrier. The metal spacer frame is assembled conventionally using corner keys and the special profile 49 can be located at the bottom and possibly also at the top edge. A foam spacer 51 serves as a thermal break to reduce conductive heat loss across the edge seal. In FIG. 7, the spacer assembly is a hollow-profile, pultruded spacer 52 incorporating an integral fin 53. As with the metal profile, the spacer frame is assembled conventionally using corner keys and the special profile 52 and fin 53 can be located at the bottom edge of the unit and also possibly at the top edge.

Figure 8:
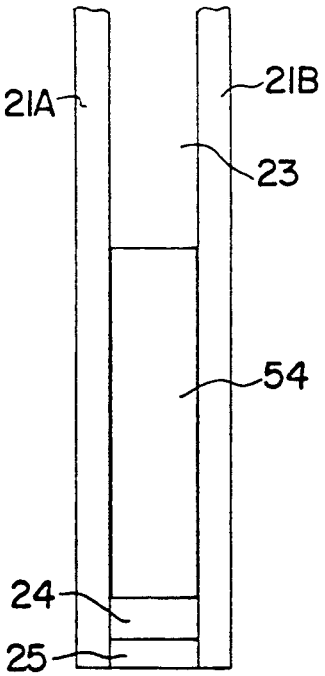
FIG. 8 is a vertical cross-section of the bottom edge of a double-glazed unit where the vertical-fence, convective-flow barrier is a strip of insulating sheet material.

As shown in FIG. 8, the convective-flow barrier can also be fabricated from a strip of insulating sheet material 54. Typically, the exterior and interior glazing sheets 21A and 21B are spaced apart by about ½ inch and as illustrated in FIG. 8, the insulating strip 54 essentially extends the full width of the sealed unit. Alternatively, the strip can be located directly adjacent to the interior glazing 21B and extend across about half the width of the sealed unit. The strip can be made from transparent, translucent or opaque insulating sheet materials. Appropriate insulating-sheet material options include: fiberglass, aerogel, acrylic hollow-fiber sheet, rock wool, honeycomb-sheet material and silicone foam. A particular advantage of the translucent fiberglass material is that the fibrous material can help dampen the velocity of the convective-flow circulation within the sealed unit.

To demonstrate the effectiveness of the convective-flow barrier, the following three experiments were carried out.

EXPERIMENT ONE

Side-by-Side Comparison of Sealed Unit With and Without a Vertical-Fence Barrier of the type shown in FIG. 2

To demonstrate the effectiveness of the convective-flow barrier, a side-by-side comparison test of glazing units with and without a vertical-fence barrier was carried out. The design of the test units was standardized with a ½ inch air-filled cavity between the glazing sheets and a low-emissivity coating on the inner face of the warm-side glazing sheet. The test units also incorporated a perimeter insulating edge seal consisting of a desiccant-filled, silicone-foam spacer backed up by hot-melt butyl sealant.

The test apparatus consisted of a cold chamber which was maintained at −17° C.±2° C. while the warm-side temperature was stable at around 20.5° C. The tests were performed with forced convective air-flow on the cold-side and natural convective air flow on the warm side. The warm-side temperatures of the test unit was measured using an Inframetrics thermographic camera and based on the infra-red image. Thermoteknix software was used to calculate and document various factors, including: surface-temperature profiles: minimum/maximum surface temperatures, and average surface temperatures etc. The infra-red thermographic camera also provided a visual multi-colored image of the warm-side surface temperatures of the test units.

Figure 9:
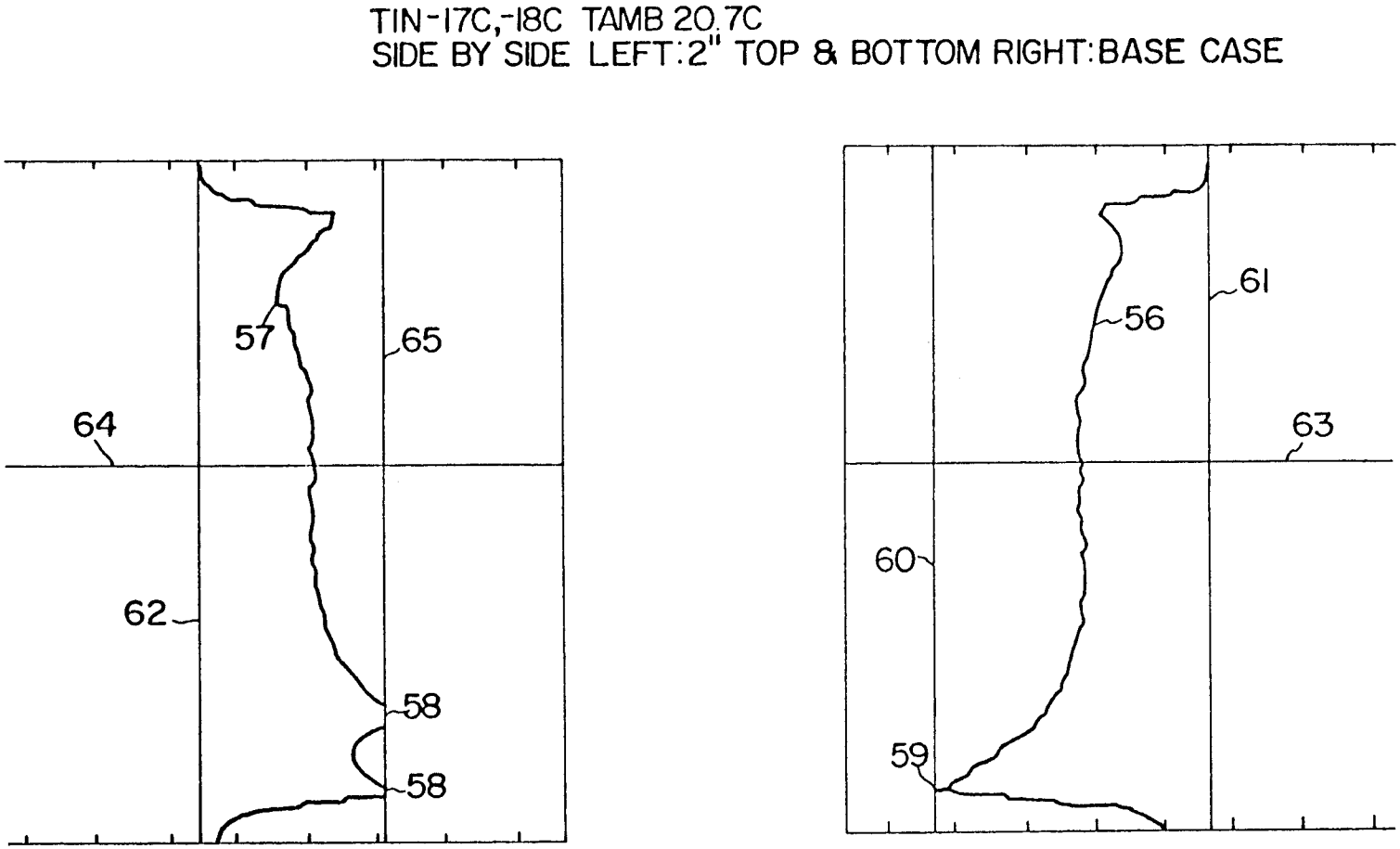
FIG. 9 is a back-to-back comparison of the temperature profiles through the vertical cross section of double-glazed units with and without a convective-flow barrier.

To allow direct back-to-back comparison, the units were sized approximately 7"×20". One test unit incorporated a 2" vertical-fence barrier, top and bottom, while the other test unit was conventional in design and incorporated bottom, while the other test unit was conventional in design and incorporated no special features. FIG. 9 illustrates the temperature profiles of the conventional test unit, as shown by line 56, and the temperature profile of the test unit with the convective-flow barrier, as shown by line 57. At the bottom edge of the unit with the convective-flow barrier, there is a double peak 58 in the temperature profile line 57 while with the conventional unit there is only a single but more extreme peak 59 at the bottom edge. Line 60 indicates the minimum bottom edge-of-glass temperature for the conventional unit which was calculated by the thermographic computer software to be 7.8° C. Line 65 indicates the minimum bottom-edge temperature for the unit with a convective-flow barrier which was calculated by the thermographic computer software to be 11.3° C.

In summary, these results show that under "cold-weather" operation (i.e. test temperature of −17° C./−18° C.), the vertical-fence barrier is very effective in increasing the bottom-edge temperature and there would be no edge-of-glass condensation even if the indoor relative humidity levels were close to 60 percent.

As would be expected, the test results show that the maximum frame-surface temperatures of the two test units are similar. Line 61 represents the maximum top-edge frame temperature for the conventional unit which was calculated by the thermographic computer software to be 18.9° C. Line 62 represents the maximum top-edge frame temperature for the unit with the convective-flow barrier which was calculated by the thermographic computer software to be 18.8° C. The center-glazing temperatures of the two test samples are also similar. Line 63 represents that the center-of-glass temperature for the conventional unit which was calculated by the thermographic computer software to be 13.9° C. and line 64 represents the center-of-glass temperature for the unit with the convective-flow barrier which was calculated by the thermographic computer software to be 14.1° C.

The Thermoteknix software was used to also calculate the average overall temperature of the test units and this analysis showed that the average overall temperature of the conventional unit was 13.2° C. and the average overall temperature for the unit with the convective-flow barrier was 13.7° C. Given the relative small area of the convective-flow barrier, this increase in overall temperature is significant and indicates that the addition of a convective-flow barrier provides overall energy savings of between 6 and 8 percent.

EXPERIMENT TWO

Optimum Height of the Vertical-Fence Barrier of the type shown in FIG. 2

To determine the optimum height of the vertical-fence barrier for a particular size of glazing unit, a series of test units (14 inches wide×20 inches high) were evaluated according to the same experimental procedures outlined in Experiment One. These test units incorporated various heights of vertical-fence, convective-flow barriers, including: ½, 1, 2 and 4 inches. For the particular test unit size evaluated, the thermographic test results showed that the ½ and 1 inch high vertical-fence had a minimal impact on the temperature profile. However, the 2 inch high vertical fence significantly increased the minimum bottom edge-of-glass temperature while in contrast, the minimum bottom-edge temperature for the 4 inch high vertical fence was about 2° C. lower than for the 2 inch high fence. In summary, this experiment clearly showed that for this particular size of glazing unit and cavity width, the optimum height of the vertical-fence barrier at the bottom edge was about two inches.

EXPERIMENT THREE

Side-by-Side Comparison of Sealed Units with a Vertical-Fence Convective-Flow Barrier shown in FIG. 2 and a Horizontal Convective-Flow Barrier shown in FIG. 4

A side-by-side comparison test was carried out to determine the comparative effectiveness of a vertical-fence and horizontal convective-flow barrier. The experimental procedures and equipment used were essentially the same as those described in Experiment One. To allow direct back-to-back comparison, the units were sized approximately 7"×20". One test unit incorporated a 2" high vertical fence at the bottom edge and the other test unit incorporated a ½" wide, horizontal barrier located 2" above the bottom edge. For the experiment, the cold-side temperature was measured to be between −19.5° C. and 8.9° C. and the warm-side temperature was measured to be 22.5° C. The thermographic test results show that while the minimum-glass temperature is only 0.3° C. higher with a vertical-fence barrier, the average overall glass temperature is 0.7° C. higher indicating that the vertical-fence design is more effective in reducing overall heat loss than the horizontal barrier.

What is claimed is:

1. In a multiple-pane sealed glazing unit, having top and bottom edges and two side edges and comprising at least two parallel glazing sheets enclosing at least one vertical cavity, and separated by a spacing and sealing assembly, the improvement comprising a convective-flow barrier comprising a substantially vertical fence located between and parallel to said glazing sheets positioned above and extending substantially along the bottom edge of the glazing unit within the cavity, said fence comprising an inverted T-shaped extruded plastics profile, whereby in operation, cold-side convective flow is prevented by the fence from directly reaching a bottom region of the warm-side glazing sheet.

2. A unit as in claim 1, further comprising a second convective-flow barrier comprising a second substantially vertical fence located between and patrallel to said glazing sheets and positioned adjacent the top edge and extending substantially along the top edge of the unit, whereby in operation, warm-side convective flow is prevented by the second fence from directly reaching a top region of the cold-side glazing sheet.

3. A unit as in claim 1 or 2 where said convective-flow barrier is made from transparent material.

4. A unit as in claim 3 where an anti-reflective coating is applied to said transparent material.

5. A unit as in claim 1 where said vertical fence is made from a strip of glazing sheet material.

6. A unit as in claim 5 where said strip is retained within said cavity by clip means.

7. A unit as in claim 1 where said vertical fence is an integral part of a thermally-broken metal spacing system used to space apart the parallel glazing sheet at said bottom edge of unit.

8. A unit as in claim 1 where said vertical fence is an integral part of plastic spacer used to space apart the parallel glazing sheets at said bottom edge of unit.

9. A unit as claimed in claim 1 wherein said spacing and sealing assembly provides an insulating edge seal.

10. A unit as claimed in claim 9 in which said insulating edge seal consists of an inner desiccant-filled form spacer backed by an outer sealant.

11. A unit as in claim 9, further comprising a second convective-flow barrier comprising a second substantially vertical fence located between and parallel to said glazing sheets and positioned adjacent the top edge and extending substantially along the top edge of the unit, whereby in operation, warm-side convective flow is prevented by the second fence from directly reaching a top region of the cold-side glazing sheet.

12. A unit as in claim 1 or claim 9 wherein said vertical fence is about two inches in height.

13. A multiple-pane sealed glazing unit, having top and bottom edges and two side edges and comprising at least two parallel glazing sheets enclosing at least one vertical cavity, and separated by spacing and sealing assembly that provides an insulating edge seal, said unit including a convective-flow barrier comprising a substantially vertical fence located between and parallel to said glazing sheets positioned above and extending substantially along the bottom edge of the glazing unit within the cavity, said fence comprising an inverted T-shaped profile, whereby in operation, cold-side convective flow is prevented by the fence from directly reaching a bottom region of the warm-side glazing sheet.

14. A unit as claimed in claim 13 in which said insulating edge seal consists of an inner desiccant-filled foam spacer backed by an outer sealant.

15. A unit as claimed in claim 13 and further comprising a second convective-flow barrier comprising a second substantially vertical fence located between and parallel to said glazing sheets and positioned adjacent the top edge and extending substantially along the top edge of the unit, whereby in operation, warm-side convective flow is prevented by the second fence from directly reaching a top region of the cold-side glazing sheet.

16. A unit as claimed in claim 13 wherein said inverted T-shaped profile is made from transparent material.

17. A unit as claimed in claim 13 wherein said inverted T-shaped profile is of a transparent plastics material and has an anti-reflective coating thereon.

18. A unit as claimed in claim 13 wherein said spacing and sealing assembly comprises a thermally-broken metal spacing system in which said vertical fence is an integral part.

19. A unit as claimed in claim 13 wherein said spacing and sealing assembly comprises a plastic spacer in which said vertical fence is an integral part.

20. A unit as claimed in claim 13 wherein said inverted T-shaped profile has a flange projecting to both sides of the upper end of the stem of the T-shape.

* * * * *